US005861786A

United States Patent [19]

Laveau

[11] Patent Number: 5,861,786

[45] Date of Patent: Jan. 19, 1999

[54] SAFETY SWITCH THAT MAY BE LOCKED WITH AN ELECTROMAGNET

[75] Inventor: David Laveau, Yriex-Venat, France

[73] Assignee: Schneider Electric SA, Boulogne Billancourt, France

[21] Appl. No.: 882,287

[22] Filed: Jun. 25, 1997

[30] Foreign Application Priority Data

Jul. 2, 1996 [FR] France ..... 96 08321

[51] Int. Cl.[6] ..... H01H 67/02

[52] U.S. Cl. ..... 335/132; 335/186; 335/189

[58] Field of Search ..... 335/132, 185, 335/186, 189, 190, 191, 192, 194

[56] References Cited

U.S. PATENT DOCUMENTS

| | | | |
|---|---|---|---|
| 4,468,977 | 9/1984 | Kummerow et al. | 335/186 |
| 4,901,046 | 2/1990 | Alsch | 335/185 |

FOREIGN PATENT DOCUMENTS

| | | |
|---|---|---|
| 0 553 885 | 8/1993 | European Pat. Off. . |
| 2 569 303 | 2/1986 | France . |
| 44 03 061 | 6/1995 | Germany . |
| WO 95/18457 | 7/1995 | WIPO . |

*Primary Examiner*—Lincoln Donovan
*Attorney, Agent, or Firm*—Oblon, Spivak, McClelland, Maier & Neustadt, P.C.

[57] ABSTRACT

Safety switch with contacts that may be switched by means of an external actuator A. A housing 10 houses an electrical contact block B and an electromagnet E and this housing has a control head 11 attached to it that may be rotated around an axis X1 and which is fitted with a push rod 15 which may be moved parallel to this axis to act on the block. The core 20 of the electromagnet moves along an axis X3 parallel to X1 and co-operates with an element 22 which blocks the push rod by means of a two-position device which permits the push rod to be blocked when the electromagnet is either supplied with power or not supplied with power respectively.

5 Claims, 2 Drawing Sheets

SAFETY SWITCH THAT MAY BE LOCKED WITH AN ELECTROMAGNET

This invention relates to a safety switch of the type which contains a housing in which there is housed an electrical contact block, and a control head attached to the housing in such a way that it may be rotated to different positions around a first axis; in such a switch, the control head has on the one hand, at least one slot for inserting an actuator and on the other hand, a transmission mechanism fitted with a roller which may be engaged by the actuator and which can rotate around a second axis, perpendicular to the first axis, and a push rod that is designed to act on the contact block and which moves parallel to the first axis by the action of the mechanism following the movement of the actuator.

An electromagnet is sometimes added to this type of switch, whose function is to block the transmission mechanism, and by this movement, the actuator remains attached to this mechanism, to permit the locking of the actuator to be controlled remotely and consequently the element—door or element of the machine—which is to be maintained in a safe position. For such known switches (for example, refer to EP-553 885 and WO 95/18 457), it is common practice to place the electromagnet with its core moving parallel to the axis of movement of the contact block push rod. It is also known (refer to FR62 569 303) to place the electromagnet transversally to block an intermediate element which transmits the movement from a slide of the transmission mechanism to the push rod of the contact block; this intermediate element involves additional risks of jamming.

It is preferable to make the locking device fitted between the electromagnet and the transmission mechanism as simple as possible, particularly so that it may be associated equally well with as little modification as possible to an electromagnet which locks when power is supplied as to an electromagnet which locks when power is not supplied. Furthermore, the locking device must be designed to withstand, without being damaged, major forces exerted by the actuator and so as to interfere as little as possible with the kinematic chain of the transmission to the contact block.

According to the invention, the electromagnet cooperates with the blocking element by means of a locking device which may be placed in two positions, allowing the push rod to be blocked when the electromagnet is either supplied with power or not is supplied with power respectively.

The blocking element is preferably a locking slide guided in straight slideways of the housing perpendicularly to the first axis and co-operating with the core of the electromagnet by means of a coupling with a reversible activation ramp, for example a part with a guide ramp which may be turned.

The locking slideway co-operates favourably with a blocking seat on a metal sheath fitted onto the end of a push rod linked to the transmission mechanism roller.

The description which will be made of a method of performing the invention, with regard to the appended diagrams, details the advantages and results obtained.

Figure 1:
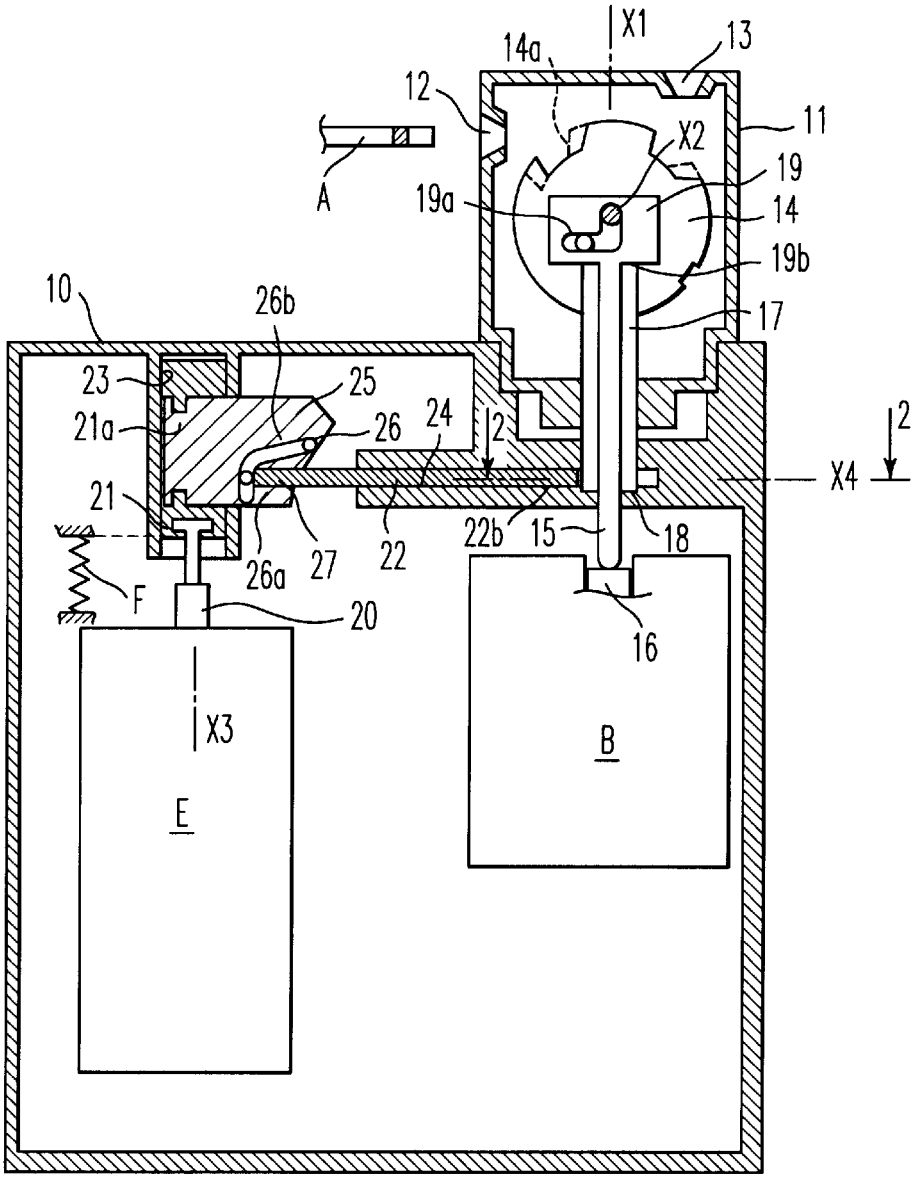
FIG. 1 shows elevation and cross sectional views of a safety switch in accordance with the invention, shown with a switch which locks when power is supplied in the unlocked position.
Figure 2:
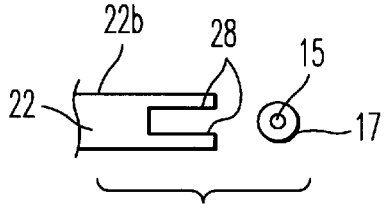
FIG. 2 is the section 2—2 of FIG. 1.
Figure 3:
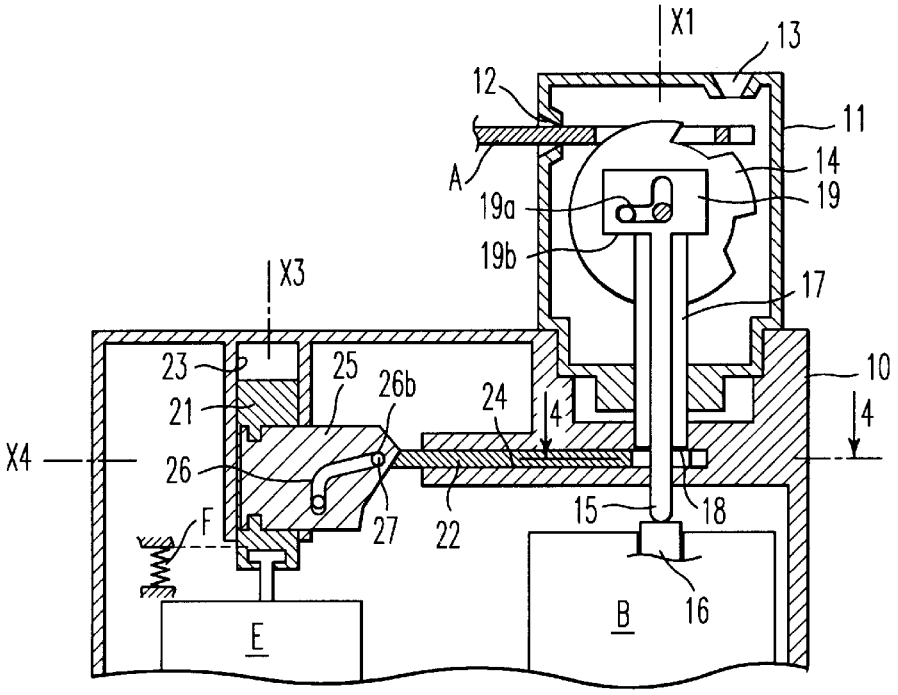
FIG. 3 is a partial view of the safety switch of FIG. 1, in the locked position.

The safety switch shown in the diagrams has a housing 10 in which are housed an electric contact block B and an electromagnet E. The housing is sealed by a cover which is not shown. A control head 11 is attached to the housing in such a way that it may be moved into 4 different positions by successive rotations of 90° around an axis X1. The head 11 has a lateral slot 12 and an upper slot 13, and a specially shaped actuator A may be inserted into one or the other of the slots in order to actuate the contacts of the block B. As is known, such an actuator is for example connected to a surrounding door or an element of the machine whose safety requires it to be closed or moved into a certain position, the contact block identifying the safety position and translating it for example by an operation authorisation. Depending on the applications, it may be more advantageous to engage the actuator A in the slot 12 or the slot 13.

The control head 11 houses a transmission mechanism 14 fitted with a roller which turns around an axis X2 that is perpendicular to X1 and a following push rod 15; the type of this mechanism is of any known type and is suitable, particularly through the special form of the actuator and of one or two blocking rollers 14*a* of the rotating roller 14, which may be commanded by the actuator, to prevent any violation of the use of the contacts. The following push rod 15 is made of plastic and protrudes past the head towards the inside of the housing, this push rod being linked to a following head 19 which has a ramp 19*a* that guides a pin or stud of the roller to translate the rotation movement of the roller into a translation movement of the push rod 15; this acts directly on a control element 16 which is dedicated to the control block B and which holds the contacts of this block. On the push rod 15 is fitted a metal sheath 17 which does not help to transmit movement to the contact block but which is intended to block the following head of the mechanism 14 when the order is sent to the coil of the electromagnet, whilst removing the blocking forces from the push rod at the same time. Depending on the cases, the sheath may be fitted to slide lightly over the push rod whilst remaining free to move with respect to it or may be held on the push rod by clamps, ratchets, etc. and is pressed at least during the locking phase, against a shoulder 19*b* of the following head to block it; an independent return spring may act on it or, more simply, by connecting the following head to the roller, a return spring attached to the latter would be sufficient to bring the assembly back to the rest position. The sheath 17 is shorter than the push rod and has a thrust seat 18 for a blocking element, as described below, this seat being located at its extreme lower end or determined by a groove.

Figure 4:
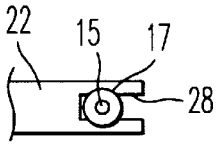
FIG. 4 is the section 4—4 of FIG. 3.

The electromagnet E has a mobile core 20 which moves in a direction X3 parallel to X1 and is actuated by a return spring F, the core being attached to a drive support bracket 21 of a slide 22; the support can move in the housing 10 in the direction X3 and is guided for this purpose in slideways 23 of the housing, whereas the slide moves in the housing in a direction X4 which is perpendicular to X1 and X3 and is guided in the straight slideways 24 of the housing. A removable coupling part 25 which may be turned is engaged, for example by means of a ratchet or interlocked in a grooved recess 21*a* of the support bracket 21; the part 25 has a ramp 26 which co-operates with a following pin 27 fitted at the end 22*a* of the slide 22 opposite the end 22*b* which co-operates with the seat 18 of the sheath 17. At end 22*b*, slide 22 has a fork 28 which permits the sheath 17 to be blocked without having to operate the push rod 15 (see FIG. 4). Of course, the turning coupling provided between the electromagnet E and the push rod 15 may be fitted differently; in particular, the ramp may belong to the end of the slide and be piloted by a finger of the support bracket 21. The support bracket may be actuated by a return spring shown schematically in the Figures.

The operation of the safety switch described will be explained with regard to FIGS. 1 to 5.

In FIG. 1, the actuator A is freed from the control head 11 so that the mechanism 14 is placed in the rest condition under the action of a return spring which is not shown and blocked in this condition by a locking element which is not shown. The push rod 15 and the metal sheath 17 are held in the lower position through the connection between the following head 19 and the rotating roller and the connection of the sheath with the roller or push rod. The element 16 of the contact block B is therefore held in the lower position and the block B is in the operating position. The electromagnet E has no power supplied to it, so that the support bracket 21 is placed in the upper position by the spring, which pulls the slide 22 to the left as the pin 27 is housed towards the end of the left side 26*a*, for example vertically, of the ramp 26. The sheath is thus free to move, and along with it the head 19 and the push rod 15, if the mechanism 14 is switched.

When the actuator is engaged in slot 12 or 13 of the housing 10 (FIG. 3), the locking element is eliminated and the mechanism 14 is placed in the operating position, so that the push rod 15 and the sheath 17 are taken to the upper position; the element 16 of the contact block B is then in the upper position and the block in the operating position. If power is supplied to the electromagnet E (FIG. 3), the spring is compressed and the support bracket 21 moves down, so that the slide is moved to the right as the pin 27 reaches the top of the angled section 26*b* of the ramp 26. The right end 22*b* of the slide is engaged under the seat 18 of the sheath 17. The result is that the contact block remains in the operating position and the actuator A cannot be removed from the control head, which means that the door or element to which the switch is associated is blocked in the safety position.

Figure 5:
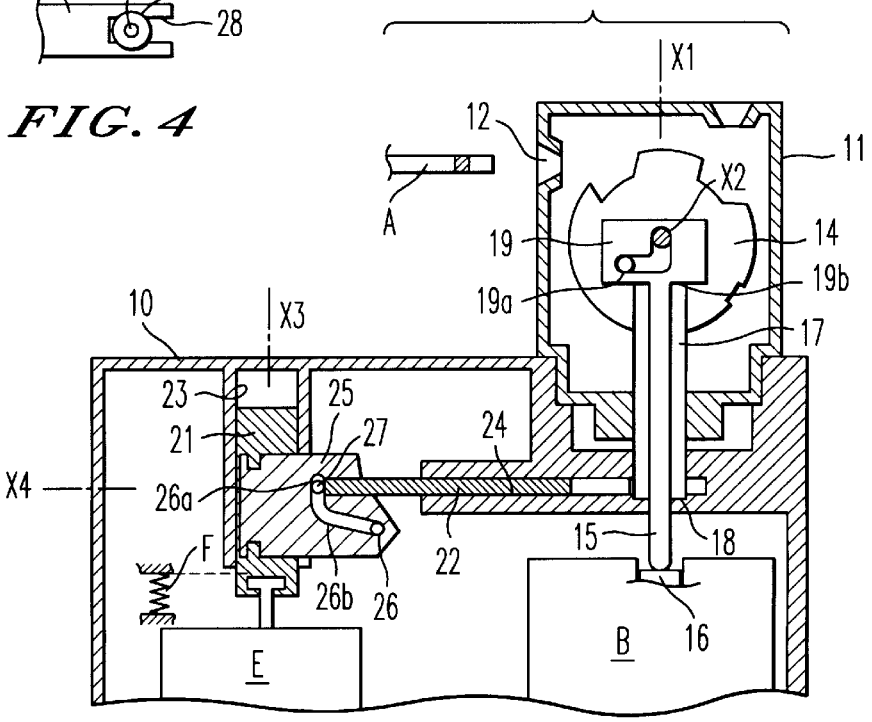
FIG. 5 shows the safety switch with a switch which locks when power is not supplied, in the unlocked position.

Alternately if the sheath 17 is to be blocked when there is no power supplied to the electromagnet, the coupling 25 is simply turned by engaging it in the grooved recess 21*a* of the support bracket 21, as shown in FIG. 5. The result is that the ramp 26 is inverted. The block B remains in the operating position and the actuator A remains engaged in the mechanism 14 when the power supply to the electromagnet E is switched off, causing the support bracket 21 to move up and push the slide 22 back to the right, as the finger 27 is then in the upper part of the vertical section 26*a* of the ramp 26.

It may be observed that in all cases, the spring F is a safety element which, when the power supply to the coil of the electromagnet is switched off, brings the switch back to its initial rest position (locked position for an electromagnet which is locked when power is supplied or the unlocked position for an electromagnet which is locked when power is not supplied).

I claim:

1. A safety switch comprising:

a housing in which is housed an electrical contact block;

a control head attached to the housing to such a way that it may be rotated to different positions around a first axis and which has at least one slot for inserting a switch actuator, a push rod which moves parallel to the first axis and a transmission mechanism fitted with a roller which can rotate around a second axis, perpendicular to the first axis, to move the push rod according to the movement of the actuator;

an electromagnet housed in the housing with a core which moves in a third axis that is parallel to the first axis and which co-operates with a blocking element which is configured to block the push rod, when the push rod is in a disengaged position; and a locking device interposed between the electromagnet and the blocking element wherein the locking device can be moved between a first position and a second position;

wherein the first position corresponds to a configuration where the locking device urges the blocking element to block the push rod when the electromagnet is supplied with power, and wherein the second position corresponds to a configuration where the blocking element urges the blocking member to block the push rod when the electromagnet is not supplied with power.

2. Safety switch of claim 1, characterized in that the blocking element is a slide fitted in straight slideways in the housing which co-operates with the core of the electromagnet through a reversible activation ramp coupling.

3. Safety switch of claim 2, characterized in that the reversible activation ramp is located on a removable part that is interlocked or fastened by means of a ratchet to a support bracket which moves in a third axis, guided in the slideways of the housing and attached to the core.

4. Safety switch of claim 1, characterized in that the blocking element of the push rod co-operates with a seat of a metal sheath co-axially fitted on the push rod to block it.

5. Safety switch of claim 4, characterized in that the metal sheath is pressed against a shoulder of the following head connected to the control mechanism.

* * * * *